US005383262A

United States Patent [19]

Brown

[11] Patent Number: 5,383,262

[45] Date of Patent: Jan. 24, 1995

[54] BLIND RIVETING SYSTEM

[75] Inventor: John Brown, Rochester Hills, Mich.

[73] Assignee: Ebbert Engineering, Inc., Troy, Mich.

[21] Appl. No.: 240,007

[22] Filed: May 9, 1994

[51] Int. Cl.[6] ..... B21J 15/34

[52] U.S. Cl. ..... 29/243.525

[58] Field of Search ..... 29/243.523, 243.524, 29/243.525, 243.521; 72/391.2

[56] References Cited

U.S. PATENT DOCUMENTS

| | | | |
|---|---|---|---|
| 2,088,859 | 8/1937 | Huck . | |
| 3,082,898 | 3/1963 | Bosch . | |
| 3,363,445 | 1/1968 | Sanders et al. . | |
| 3,451,248 | 6/1969 | Bell . | |
| 3,457,763 | 7/1969 | Freeman . | |
| 3,516,537 | 2/1970 | Champoux et al. . | |
| 3,523,441 | 8/1970 | Bell et al. . | |
| 3,898,833 | 8/1975 | Richardson . | |
| 3,962,780 | 6/1976 | Kindig . | |
| 4,130,006 | 12/1978 | Ebbert et al. | 29/243.525 |
| 4,515,005 | 5/1985 | Klein | 29/243.525 |
| 4,580,435 | 4/1986 | Port et al. | 29/243.525 |
| 4,903,522 | 2/1990 | Miller | 29/243.525 |

*Primary Examiner*—David Jones
*Attorney, Agent, or Firm*—Gifford, Krass, Groh, Sprinkle, Patmore, Anderson and Citkowski

[57] ABSTRACT

A blind riveting system is disclosed having a rivet gun with a housing defining a fluid chamber. A piston is slidably mounted in the fluid chamber and is moveable between a forward and a retracted position. The piston divides the fluid chamber into a drive chamber and a return chamber. A first source of incompressible fluid is fluidly connected to the drive chamber while, similarly, a second source of incompressible fluid is fluidly connected with the return chamber. A trigger on the rivet gun is moveable between an actuated position and a release position. Upon movement of the trigger to its actuated position pressurized, and incompressible fluid is provided under pressure to the drive chamber which drives the piston towards the retracted position, and in doing so, fastens the blind rivet. Upon release of the trigger, pressurized incompressible fluid is provided to the return chamber to thereby return the piston to its forward position in preparation for a subsequent riveting operation.

7 Claims, 2 Drawing Sheets

BLIND RIVETING SYSTEM

BACKGROUND OF THE INVENTION

I. Field of the Invention

The present invention relates to blind riveting systems.

II. Description of the Prior Art

There are many previously known blind riveting systems which are used primarily in industrial applications. Such systems typically comprise a rivet gun having an internal fluid chamber. A piston is mounted within this fluid chamber which divides the fluid chamber into a drive chamber and a return chamber.

The shank of a blind rivet is then inserted into an opening in the gun while the head of the rivet is inserted into registering openings in the parts to be fastened together. Actuation of the gun fluidly connects the drive chamber in the gun to a source of pressurized incompressible fluid, such as hydraulic fluid, which drives the piston from its forward position towards its retracted position. Simultaneously, a puller assembly attached to the piston grasps the shank of the blind rivet and pulls this shank into the interior of the bore. In doing so, the head of the blind rivet expands and secures the parts together. The movement of the piston to its retracted position also breaks the shank from the blind rivet and this now separated shank is removed to a collection area by a vacuum system.

Following the fastening of the blind rivet, the trigger on the rivet gun is released. Upon release, the return fluid chamber in the rivet gun is fluidly connected with a source of pneumatic pressure which then returns the piston to its forward position in preparation for a subsequent blind riveting operation.

These previously known blind rivet guns have generally used hydraulic or air pressure to drive the piston from its forward to its retracted position and thus perform the blind riveting operation. Likewise, these previously known blind riveting systems have generally utilized pneumatic or a spring pressure to return the piston in the gun to its forward position in preparation for a subsequent blind riveting operation. Such blind riveting systems, however, have suffered from several disadvantages.

One disadvantage of these previously known blind riveting systems is that the shanks separated from the blind rivet can become jammed in the gun upon separation of the shank from the head of the rivet. Furthermore, when this happens, the pneumatic pressure utilized to return the piston to its forward position in preparation for a subsequent riveting operation is insufficient to overcome the jammed shank in the gun. Consequently, when this happens, some disassembly of the gun is required in order to clear the jam and allow continued operation of the gun.

A still further disadvantage of these previously known blind riveting systems is that, since pneumatic or spring pressure is utilized to return the piston from its retracted to its forward position, the pneumatic pressure must necessarily pump the hydraulic fluid in the drive chamber back to its source. While conventional shop pressure is normally sufficient to return the piston from its retracted to its forward position, the return cycle time is relatively slow. This adversely effects the overall operating cycle time of the blind riveting system.

SUMMARY OF THE PRESENT INVENTION

The present invention provides a blind riveting system which overcomes all of the above mentioned disadvantages of the previously known devices.

In brief, the blind riveting system of the present invention includes a rivet gun having a fluid chamber. A piston is mounted within the fluid chamber and divides the fluid chamber between a drive chamber and a return chamber.

Like the previously known guns, the shank of a blind rivet is inserted into an opening in the gun while a puller assembly secured to the piston grasps the shank as the piston is driven from its forward position to its retracted position. In doing so, the shank expands the head of the blind rivet until the shank snaps from the head of the blind rivet. The shank is then discarded, preferably by evacuation to a collection area.

Unlike the previously known blind riveting systems, however, the blind riveting system of the present invention utilizes hydraulic fluid, i.e. an incompressible fluid, to return the piston from its retracted position to its forward position following a riveting operation and in preparation for a subsequent riveting operation.

By utilizing hydraulic pressure to return the piston to its forward position, potential jamming of the rivet gun is minimized. Furthermore, hydraulic pressure returns the piston to its forward position more rapidly than pneumatic pressure thereby reducing the cycle time for the rivet gun.

BRIEF DESCRIPTION OF THE DRAWING

A better understanding of the present invention will be had upon reference to the following detailed description, when read in conjunction with the accompany drawing, wherein like reference characters refer to like parts throughout the several views, and in which.

DETAILED DESCRIPTION OF A PREFERRED EMBODIMENT OF THE PRESENT INVENTION

Figure 1:
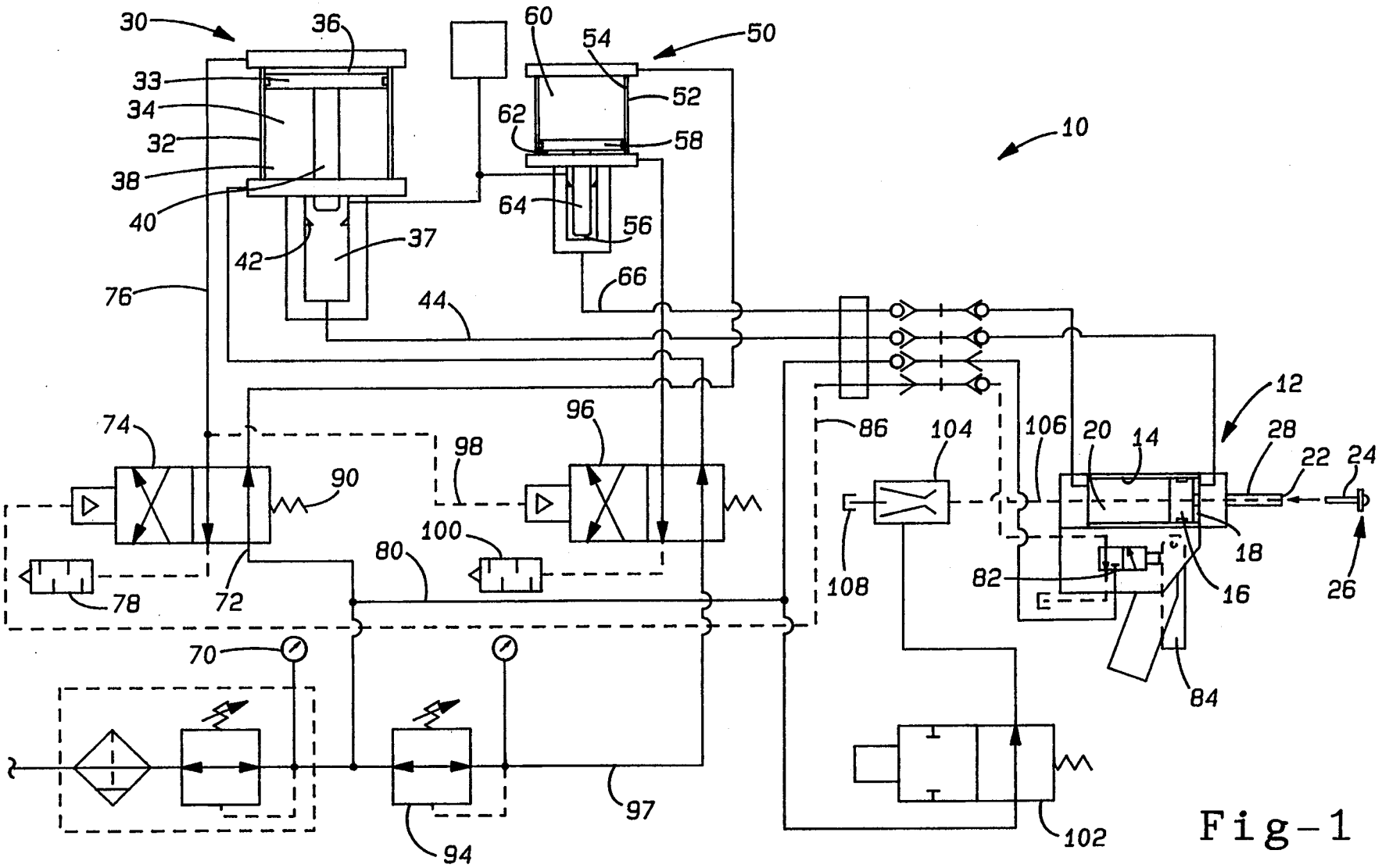
FIG. 1 is a diagrammatic view illustrating the blind riveting system of the present invention in a state ready to initiate a riveting operation.
Figure 2:
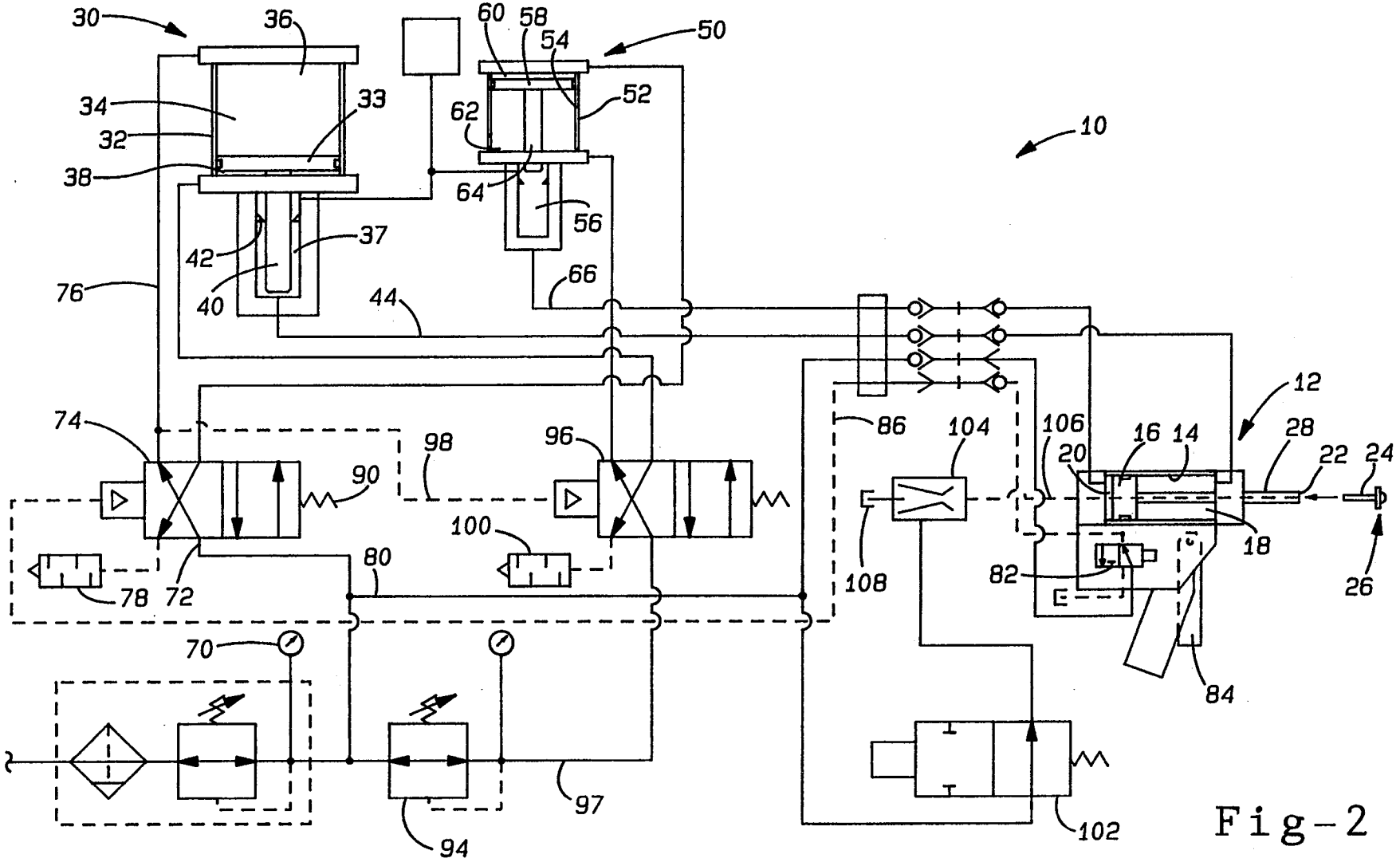
FIG. 2 is a diagrammatic view similar to FIG. 1 but illustrating the state of the blind riveting system of the present invention following completion of a riveting operation.

With reference first to FIG. 1, a diagrammatic view of a preferred embodiment of the blind riveting system 10 of the present invention is thereshown and comprises a rivet gun 12 having an internal cylindrical fluid chamber 14. A piston 16 is axially slidably mounted within the fluid chamber 14 and divides the fluid chamber 14 into a drive chamber 18 and a return chamber 20. The piston 16 is movable between a forward position (FIG. 1) and a retracted position (FIG. 2).

The rivet gun 12 includes an elongated bore 22 in alignment with the piston 18. This bore 22 is adapted to slidably receive an elongated shank 24 of a blind rivet 26. Additionally, a puller assembly 28 is mechanically attached to and moves in unison with the piston 16. This puller assembly 28 grasps the shank 24 of the blind rivet 26 during a riveting operation. Thus, with the shank 24 of the blind rivet inserted into the bore 22, the puller assembly 28 grasps the shank 24 as the piston is driven from its forward position (FIG. 1) to its retracted position (FIG. 2) thus attaching the blind rivet 26 to the workpiece (not shown) in the desired fashion.

Still referring to FIG. 1, a first power booster 30 is provided for driving the piston 16 from its forward to its retracted position. The power booster 30 is conventional in construction and includes a housing 32 defining a cylindrical pneumatic chamber 34 and a cylindrical hydraulic chamber 37 which is axially aligned with the pneumatic chamber 34. A piston 33 is axially slidably mounted within the pneumatic chamber 34 thus dividing the pneumatic chamber 34 into a first chamber 36 and second chamber 38. A plunger 40 is also secured to and moves in unison with the piston 33. This plunger 40 is axially slidably received within the hydraulic chamber 37. Appropriate fluid seals 42 also fluidly seal the housing 32 to the plunger 40. Seals (not shown) are also provided between the pneumatic chamber 34 and hydraulic chamber 37.

A fluid line 44 fluidly connects the hydraulic chamber 37 with the drive chamber 18 in the rivet gun 12. Consequently, as the piston 33 moves from the position shown in FIG. 1 to the position shown in FIG. 2 in a fashion to be subsequently described, the plunger 40 pumps hydraulic fluid from the chamber 37 to the drive chamber 18 in the rivet gun 12 thus driving the rivet gun piston 16 from its forward to its retracted position and performing the riveting operation.

A second power booster assembly 50 is provided for driving the rivet gun piston 16 from its retracted position to its forward position in preparation for a subsequent riveting operation. The power booster assembly 50, like the power booster assembly 30, includes a housing 52 defining a cylindrical pneumatic chamber 54 and an aligned hydraulic chamber 56. A piston 58 is axially slidably mounted in the pneumatic chamber 54 thus dividing the chamber 54 into a first fluid chamber 60 and a second fluid chamber 62. A plunger 64 is also secured to the piston 58 which is axially slidably received within the hydraulic chamber 56. Consequently, movement of the plunger 64 from the position shown in FIG. 2 to the position shown in FIG. 1 pumps hydraulic fluid from the chamber 56.

The hydraulic chamber 56 in the second power booster assembly 50 is fluidly connected by a line 66 to the return fluid chamber 20 in the rivet gun 12. Consequently, movement of the piston 58 with its attached plunger 64 from the position shown in FIG. 2 to the position shown in FIG. 1 in a fashion that will be subsequently described, pumps hydraulic fluid from the chamber 56 into the chamber 20 and thus returns the rivet gun piston 16 to its forward position in preparation for a subsequent riveting operation.

In each power booster assembly 30 and 50 the cross sectional area of the respected pneumatic chambers 34 and 60 is several times larger than the cross sectional area of the respective hydraulic chambers 37 and 56. As such, pneumatic pressure supplied to the pneumatic chambers 34 and 60 provide an amplified hydraulic pressure output. Furthermore, the power booster assembly 30 is larger than the power booster assembly 50 since more power is required to perform the blind riveting operation than is required to return the rivet gun piston 16 to its forward position.

FIG. 1 represents the blind riveting system of the present invention in an "at rest" condition, i.e. the system is ready to perform a blind riveting operation but has not yet initiated the blind riveting operation. In this condition, a source 70 of pneumatic pressure is fluidly connected by line 72 and valve 74 to the pneumatic chamber 60 in the second power booster assembly 50. Thus, the source 70 of pneumatic pressure maintains the piston 58 in the second booster assembly 50 in its extended or lower position so that hydraulic fluid contained in the hydraulic chamber 56 is pumped through the line 66 to the return chamber 20 in the rivet gun 12 this pressure maintains the rivet gun piston 16 in its forward position in preparation for a blind riveting operation.

Simultaneously, the valve 74 allows the pneumatic pressure contained within the pneumatic chamber 36 in the first power booster assembly 30 to exhaust through a pneumatic line 76 and muffler 78. Furthermore, since the rivet gun piston 16 is in its forward position, hydraulic fluid contained within the drive chamber 18 in the rivet gun 12 is pumped back into the hydraulic chamber 37 in the first power booster assembly 30.

The source 70 of pneumatic pressure is also fluidly connected by a line 80 to a trigger valve 82 mounted on the rivet gun 12. This trigger valve 82 is movable between a released position, illustrated in FIG. 1, and in actuated position, illustrated in FIG. 2, by a trigger 84. In its released position (FIG. 1) the trigger valve 82 prohibits fluid flow though the pneumatic line 80.

With reference now to FIG. 2 the trigger 84 is moved to an actuated position (FIG. 2) in order to initiate the blind riveting operation. When this occurs, the trigger 84 shifts the trigger valve 82 to its actuated position so that the trigger valve 82 fluidly connects the source 70 of pneumatic pressure to a pneumatic line 86 which shifts the valve 74 to its actuated position illustrated in FIG. 2. When this occurs, the valve 74 fluidly connects the pneumatic pressure source 70 to the first fluid chamber 36 on the first power booster assembly 30. Simultaneously, the valve 74 fluidly connects the fluid chamber 60 of the second power booster assembly 50 to the exhaust muffler 78.

Consequently, when the trigger 84 is moved to its actuated position, the piston of the first power booster 30 is pneumatically driven to its extended lower position. This simultaneously pumps hydraulic fluid from the hydraulic chamber 37 to the drive chamber 18 and hydraulically drives the rivet gun piston 16 to its retracted position illustrated in FIG. 2. As the piston 16 is driven from its forward position to its retracted position, the puller assembly 28 grasps the shank 24 of the blind rivet 26 to perform the riveting operation in the conventional fashion.

Simultaneously as the rivet gun piston 16 is driven to its retracted position, the hydraulic fluid previously contained within the rivet gun return chamber 20 is pumped back to the hydraulic chamber 56 on the second power booster assembly 50.

Upon release of the trigger 84 following a riveting operation, the trigger valve 82 again terminates the actuating pressure to the valve 74 so that a spring 90 returns the valve 74 to its "at rest" position illustrated in FIG. 1. When this occurs, the pistons 33 and 58 in the power booster assemblies 30 and 50 are pneumatically driven to their position illustrated in FIG. 1 as previously described. In doing so, the second power booster assembly 50 hydraulically pumps hydraulic fluid into the return chamber 20 thus hydraulically returning the rivet gun piston 16 to its forward position (FIG. 1) in preparation for a subsequent riveting operation.

Referring again to FIG. 1, the source 70 of pneumatic pressure is also fluidly connected through a pressure reducer 94 so that the outlet 97 from the pressure reducer 94 is approximately 25 psi. This fluid pressure is fluidly connected to a valve 96 which is actuated from its at rest position (FIG. 1) to its actuated position (FIG. 2) in unison with the valve 74 via a pneumatic line 98. This reduced pressure from the pressure reducer 94 is selectively provided to the second fluid chamber 38 in the first power booster assembly 30 when in the "at rest" condition (FIG. 1) and to the second pneumatic chamber 62 of the second booster assembly 50 when the system 10 is in its actuated condition (FIG. 2). This reduced pressure from the pressure regulator 94 serves two purposes. First, the pressure from the pressure regulator 94 pneumatically drives the pistons 33 and 58 in the power assemblies 30 and 50, respectively, to their upper or retracted position. In doing so, the pistons 33 and 58 depressurize their respective hydraulic chambers 37 and 56 which facilitates the evacuation of the hydraulic fluid from the rivet gun chambers 18 and 20 and reduces overall cycle time. Secondly, the reduced pressure from the pressure reducer 94 insures that the pistons 33 and 58 are completely returned to their fully retracted position at the completion of their stroke.

The valve 96 also serves to fluidly connect the pneumatic chamber 62 in the second power booster assembly 50 to atmospheric exhaust through a muffler 100 when the rivet gun 12 is at rest (FIG. 1). Likewise, the valve 96 fluidly connects the second pneumatic chamber 38 in the first power booster assembly 30 to atmospheric exhaust through the muffler 100 when the trigger 84 is moved to its actuated position (FIG. 2).

Referring now to FIG. 2, the source 70 of pneumatic pressure is also connected by line 80 through a valve 102 to a venturi vacuum pump 104. This vacuum pump is connected by a fluid line 106 to the bore 22 in the puller assembly 28. Thus when the shank 24 is separated from the rivet 26, the shank 24 is evacuated out through the fluid line 106 by the vacuum pump 104 to a collection area 108. The valve 102 allows the vacuum 104 to be shut off when the rivet gun 12 is not in use in order to conserve pneumatic pressure as well as noise reduction.

From the foregoing, it can be seen that the present invention provides a blind riveting system which utilizes hydraulic pressure to both perform the riveting operation as well as to return the piston 16 in the rivet gun to its forward position in preparation for a subsequent riveting operation. The present invention thus achieves fast cycle time for the riveting gun 12 and also reduces the likelihood of jams in the rivet gun 12.

Having described my invention, however, many modifications thereto will become apparent to those skilled in the art to which it pertains without deviation from the spirit of the invention as defined by the scope of the appended claims.

I claim:

1. A blind riveting system comprising:

a rivet gun having a housing defining a fluid chamber, a piston slidably mounted in said fluid chamber between a forward position and a retracted position, said first piston dividing said fluid chamber into a drive chamber and a return chamber, means attached to said piston for gripping a shank of a rivet, a first source of incompressible fluid, means for fluidly connecting said first source with said drive chamber, a second source of incompressible fluid, means for fluidly connecting said second source with said return chamber, a trigger movable between an actuated position and a released position, means responsive to movement of said trigger to said actuated position for pressurizing said first source of incompressible fluid, and means responsive to movement of said trigger to said released position for pressurizing said second source of incompressible fluid.

2. The invention as defined in claim 1 and further comprising means responsive to movement of said trigger to said actuated position for depressurizing said second source of incompressible fluid, and means responsive to movement of said trigger to said released position for depressurizing said first source of incompressible fluid.

3. The invention as defined in claim 1 wherein said first and second sources of incompressible fluid comprise hydraulic fluid.

4. The invention as defined in claim 1 wherein said first source of incompressible fluid comprises an elongated tubular cylinder defining a hydraulic chamber which contains said incompressible fluid, and wherein said first pressurizing means comprises a plunger disposed in said hydraulic chamber, and means for pneumatically axially driving said plunger in said hydraulic chamber.

5. The invention as defined in claim 1 wherein said second source of incompressible fluid comprises an elongated tubular cylinder defining a hydraulic chamber which contains said incompressible fluid, and wherein said second pressurizing means comprises a plunger disposed in said hydraulic chamber, and means for pneumatically axially driving said plunger in said hydraulic chamber.

6. The invention as defined in claim 4 wherein said pneumatic driving means comprises a source of pneumatic pressure, a pneumatic cylinder, a drive piston slidably mounted in said pneumatic cylinder and dividing said pneumatic cylinder into a first and second pneumatic chambers, means for mechanically connecting said plunger with said drive piston, and means response to movement of said trigger to said actuated position for fluidly connecting said source of pneumatic pressure to said first pneumatic chamber.

7. The invention as defined in claim 5 wherein said pneumatic driving means comprises a source of pneumatic pressure, a pneumatic cylinder, a drive piston slidably mounted in said pneumatic cylinder and dividing said pneumatic cylinder into a first and second pneumatic chambers, means for mechanically connecting said plunger with said drive piston, and means response to movement of said trigger to said released position for fluidly connecting said source of pneumatic pressure to said first pneumatic chamber.

* * * * *